US005769367A

United States Patent [19]

Bradley et al.

[11] Patent Number: 5,769,367

[45] Date of Patent: Jun. 23, 1998

[54] NURSING BOTTLE PROPPING APPARATUS

[76] Inventors: Monica Bradley; Ronald Bradley, both of 11351 NW. 29th St., Sunrise, Fla. 33323

[21] Appl. No.: 631,597

[22] Filed: Apr. 15, 1996

Related U.S. Application Data

[63] Continuation-in-part of Ser. No. 585,731, Jan. 16, 1996.

[51] Int. Cl.[6] ..... A47D 15/00

[52] U.S. Cl. ..... 248/102; 248/104; 248/160

[58] Field of Search ..... 248/102, 103, 248/104, 105, 106, 107, 160, 165, 205.2, 276.1

[56] References Cited

U.S. PATENT DOCUMENTS

| | | | |
|---|---|---|---|
| 1,287,125 | 12/1918 | Smith | 248/102 |
| 1,340,974 | 5/1920 | O'Reilly | 248/105 |
| 1,863,163 | 6/1932 | Malti et al. | 248/102 |
| 2,542,694 | 2/1951 | Miller | 248/107 |
| 2,638,296 | 5/1953 | Battle | 248/105 |
| 2,717,753 | 9/1955 | Schweikert | 248/165 |
| 2,909,345 | 10/1959 | Matsuoka | 248/106 |
| 3,222,020 | 12/1965 | Rea | 248/106 |
| 3,289,986 | 12/1966 | Martin | 248/103 |
| 3,519,231 | 7/1970 | Miller | 248/106 |
| 3,635,431 | 1/1972 | Mariner | 248/104 |
| 3,999,731 | 12/1976 | Filip | 248/107 |
| 4,405,106 | 9/1983 | Adler | 248/102 |
| 4,616,795 | 10/1986 | Bender | 248/105 |
| 4,750,696 | 6/1988 | Shan-Liang | 248/102 |

*Primary Examiner*—Leslie A. Braun
*Assistant Examiner*—Anita M. King
*Attorney, Agent, or Firm*—Frank L. Kubler

[57] ABSTRACT

An apparatus for propping a nursing bottle so that an infant child can drink from the bottle includes a bottle holding portion; and an apparatus mounting portion including at least two mutually diverging first flexible members for abutting the sides of the torso of an infant child to removably secure the apparatus to the child with friction engagement. The first flexible members preferably each include pliant material for bending by hand to conform to and fit against the waist of an individual child. The first flexible members alternatively each include resilient material having elastic memory and pre-shaped to lightly resiliently grip the front and sides of the infant waist. The first flexible members are preferably at least partly covered with or contain a high friction material. The high friction material is preferably non-toxic rubber tubing. The bottle holding portion preferably includes at least two mutually diverging second flexible members for abutting the sides of the nursing bottle to removably secure the nursing bottle in the apparatus. The apparatus preferably additionally includes a pliant and flexible connecting link interconnecting the bottle holding portion and the apparatus mounting portion, for positioning the nursing bottle holding portion, and thereby positioning the bottle, relative to the mouth of the child. Toys having ring portions are preferably slidably mounted on the connecting link. The apparatus preferably glows in the dark for night time parental monitoring.

18 Claims, 3 Drawing Sheets

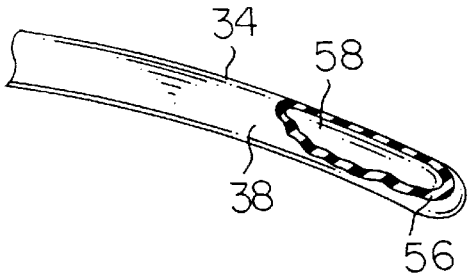
FIG. 6
FIG. 7
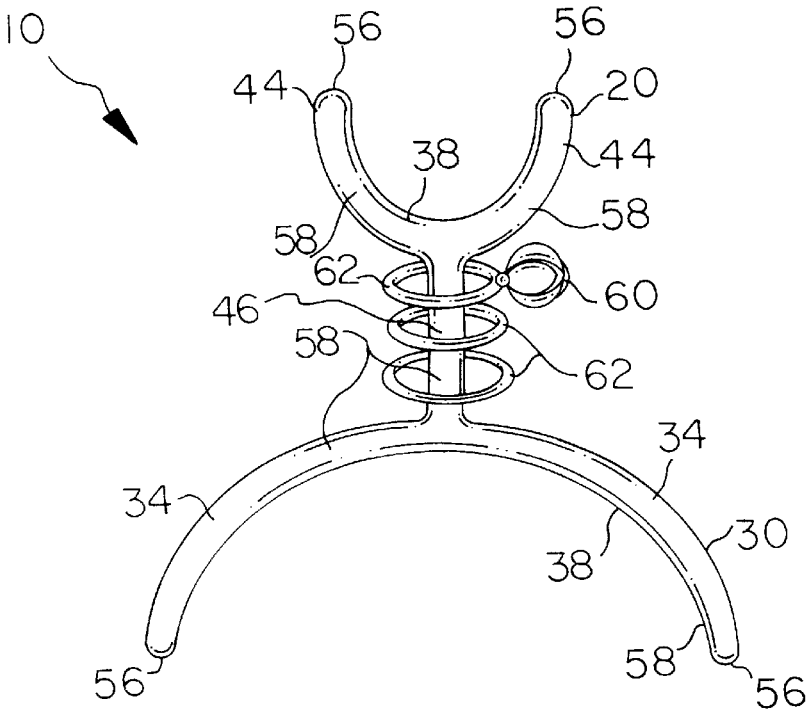

NURSING BOTTLE PROPPING APPARATUS

FILING HISTORY

This application is a continuation-in-part of application Ser. No. 08/585,731, filed on Jan. 16, 1996.

BACKGROUND OF THE INVENTION

1. Field of the Invention

The present invention relates generally to the field of child care devices. More specifically the present invention relates to an apparatus for removably securing a nursing bottle to a child and positioning the bottle so that the infant child can drink from it. The apparatus generally includes a bottle holding portion and an apparatus mounting portion for fitting the apparatus onto the child.

The mounting portion includes two mutually diverging first flexible members which wrap around the sides of the waist of an infant child to removably secure the apparatus to the child with friction engagement. The first flexible members preferably each include a pliant segment of ductile or plastic material having virtually no elastic memory and thus retaining the shape into which it was last bent. Alternatively, the first flexible members each include a segment of resilient material having a substantial elastic memory and shaped to lightly grip the front and sides of the child waist. The flexible members are optionally covered with or include a high friction material, such as a non-toxic rubber tubing.

The bottle holding portion preferably includes two second flexible members, of the construction described above, diverging from a flexible connecting link. The link extends from the mounting portion. These second flexible members are for holding the sides of a nursing bottle with high friction engagement.

The flexible connecting link permits positioning of the bottle holding portion, and thus of the bottle itself, relative to the mouth of the child. The connecting link permits tilting of the bottle to a desired longitudinal angle from horizontal and also permits tilting of the bottle from side to side, depending on the position of the head of the child at the moment. The first and second flexible members and connecting link are preferably interconnected to form a substantially H-shaped apparatus of ductile or resilient material.

2. Description of the Prior Art

There have long been devices for holding a nursing bottle while a child drinks from the bottle. These devices have generally been awkward, cumbersome structures, some of which potentially endanger the child.

Adler, U.S. Pat. No. 4,405,106, issued on Sep. 20, 1983, discloses a bottle support structure which is attached directly to the child. Adler teaches a baby bottle holder including a bottle clip extending laterally from an arm portion. The arm portion is pivotally connected to a mounting panel which rests on the chest of the child. The free end of the arm portion doubles back to fit into any one of several loops on the upper face of the panel, to secure the bottle at a desired angle relative to the panel and the child. Straps extend from opposing lateral edges of the panel for wrapping and fastening around the chest of the child. A problem with Adler is that the straps could bind around and injure the child. Another problem with Adler is that the device is too heavy and cumbersome for placement on the chest of a premature baby. Still another problem is that the Adler straps wrap around the baby so that the baby would have to be either lifted or rolled on top of the straps to secure and remove the device from the baby. Finally, Adler is needlessly complex.

Other prior patents disclose bottle propping devices which are secured to a child bed or seat. Malti, et al., U.S. Pat. No. 1,863,163, issued on Jun. 14, 1932, reveals a bottle support device including an arch member secured at each end to opposing sides of a crib. A bottle clip is mounted on a support arm secured with a thumb set screw to the arch member. A problem with Malti, et al., is that the device can be used only when the child is in a crib and the crib must have a suitable width and rail construction. Another problem is that the Malti, et al., device is too long to conveniently carry, such as in a purse. Still another problem is that the bottle does not follow the child as the child moves in the crib. Finally, Malti, et al., would be relatively expensive to manufacture.

Mariner, U.S. Pat. No. 3,635,431, issued on Jan. 18, 1972, teaches a bottle holder similar to that of Malti, et al. Ends of a squared arch member grip opposing sides of an infant seat with spring clamps. The middle segment of the arch member is configured to receive and hold the bottle. The problems of Malti, et al., are again presented.

Martin, U.S. Pat. No. 3,289,986, issued on Dec. 6, 1966, discloses a holder for a nursing bottle and for other child items. Martin provides a bottle clip at one end of a flexible goose neck stem similar to those supporting bulbs and shades of some desk lamps. The other end of the goose neck stem is fastened onto one side of a child bed. A problem with Martin is that the child must be in a bed having a side rail suitable for holder engagement. And, once again, the Martin device does not cause the bottle to move with the child.

Filip, U.S. Pat. No. 3,999,731, issued on Dec. 28, 1976, provides a bottle holder supported by a frame structure which rests on top of a mattress and surrounds the child. Matsuoka, U.S. Pat. No. 2,909,345, issued on Oct. 20, 1959, discloses a nursing bottle supported in a clip on a cantilever structure. The structure is anchored with a loop foot portion which is inserted beneath the baby. A problem with Filip and Matsuoka is that their support structures are cumbersome and might fall onto the child. And these devices do not cause the bottle to follow the child as the child moves.

Miller, U.S. Pat. No. 3,519,231, issued on Jul. 7, 1970, illustrates a nursing bottle stand. Miller is essentially the same structure taught by Matsuoka, except that the foot portion is a solid plate rather than a wire loop. The problems of Matsuoka are again presented.

It is thus an object of the present invention to provide a nursing bottle holding and positioning apparatus which is secured directly to the waist of an infant child to move with the child, and to potentially slide off the child should the child move into a position which pulls on the apparatus.

It is another object of the present invention to provide such an apparatus which may be quickly and easily fitted onto and removed from a child, without need of lifting the child.

It is another object of the present invention to provide such an apparatus which is suitable for holding and positioning a bottle while the child is either sitting or lying down, regardless of whether the child is in a stroller, a child seat, or elsewhere.

It is yet another object of the present invention to provide such an apparatus which can entertain a child with slidably attached toys.

It is still another object of the present invention to provide such an apparatus which glows in the dark for parental monitoring in a dark room, such as while other children are sleeping.

It is a further another object of the present invention to provide such an apparatus which is suitably light in weight for premature babies.

It is finally an object of the present invention to provide such an apparatus which is simple in design, inexpensive to manufacture as well as compact to store and carry.

SUMMARY OF THE INVENTION

The present invention accomplishes the above-stated objectives, as well as others, as may be determined by a fair reading and interpretation of the entire specification.

An apparatus is provided for propping a nursing bottle so that an infant child can drink from the bottle, including a bottle holding portion; and an apparatus mounting portion including at least two mutually diverging first flexible members for abutting the sides of the torso of an infant child to removably secure the apparatus to the child with friction engagement. The first flexible members preferably each include a skeleton segment of ductile material for bending by hand to conform to and fit against the waist of an individual child. The first flexible members alternatively each include a skeleton segment of resilient material having elastic memory and pre-shaped to lightly resiliently grip the front and sides of the infant child waist. The first flexible members are preferably at least partly covered with a high friction material. The high friction material is preferably non-toxic rubber tubing and preferably includes a substance which glows in the dark to permit monitoring by parents in a dark room. The bottle holding portion preferably includes at least two mutually diverging second flexible members for abutting the sides of the nursing bottle to removably secure the nursing bottle in the apparatus. The apparatus preferably additionally includes a ductile and flexible connecting link interconnecting the bottle holding portion and the apparatus mounting portion, for positioning the nursing bottle holding portion, and thereby positioning the bottle, relative to the mouth of the child. The skeleton segments of the first and second flexible members and the connecting link together preferably include a substantially H-shaped skeleton of ductile flexible material, where the middle link of the H-shaped skeleton includes the connecting link, and where one upright bar of the H-shaped skeleton includes the two first flexible members diverging from the connecting link and where the other upright bar of the H-shape skeleton includes the two second flexible members diverging from the connecting link. The high friction material preferably substantially encloses every segment of the skeleton, to provide high friction apparatus engagement of the bottle and of the child, and to shield the child from direct contact with the skeleton.

The first flexible members are alternatively formed of a polymer rubber material capable of being bent by hand to conform to and fit against the waist of an individual child and to substantially retain the shape into which the material was last bent. The first flexible members are still alternatively formed of a resilient polymer rubber material having an elastic memory and pre-shaped to lightly and resiliently grip the front and sides of the infant waist.

The apparatus preferably additionally includes a flexible connecting link interconnecting the bottle holding portion and the apparatus mounting portion, for positioning the nursing bottle holding portion, and thereby positioning the bottle, relative to the mouth of the child; and a child entertaining object having a ring portion, the ring portion slidably encircling the connecting member. The polymer rubber material preferably includes a substance which glows in the dark to permit monitoring by parents in a dark room.

A nursing bottle propping apparatus is also provided for an infant child, including a nursing bottle; a bottle holding portion; and an apparatus mounting portion including at least two mutually diverging first flexible members for abutting the sides of the torso of an infant child to removably secure the apparatus to the child with friction engagement. The apparatus mounting portion may be formed of a polymer rubber material capable of being bent by hand to conform to and fit against the waist of an individual child and to substantially retain the shape into which the material was last bent. The apparatus mounting portion is alternatively formed of a resilient polymer rubber material having an elastic memory and pre-shaped to lightly and resiliently grip the front and sides of the infant waist. The apparatus mounting portion still alternatively includes a ductile interior skeleton. The apparatus preferably includes material including a substance which glows in the dark for parental monitoring in a dark room.

BRIEF DESCRIPTION OF THE DRAWINGS

Various other objects, advantages, and features of the invention will become apparent to those skilled in the art from the following discussion taken in conjunction with the following drawings, in which:

FIG. 6 is a view as in FIG. 3 with some of the polymer rubber material stripped away to reveal the preferred uniform and monolithic first or second flexible member or connecting link cross-section. FIG 7. is a perspective view of the apparatus with the ring toys slidably and loosely mounted on the connecting link. The radiating lines represent the glow-in-the-dark feature.

DETAILED DESCRIPTION OF THE PREFERRED EMBODIMENTS

Figure 1:
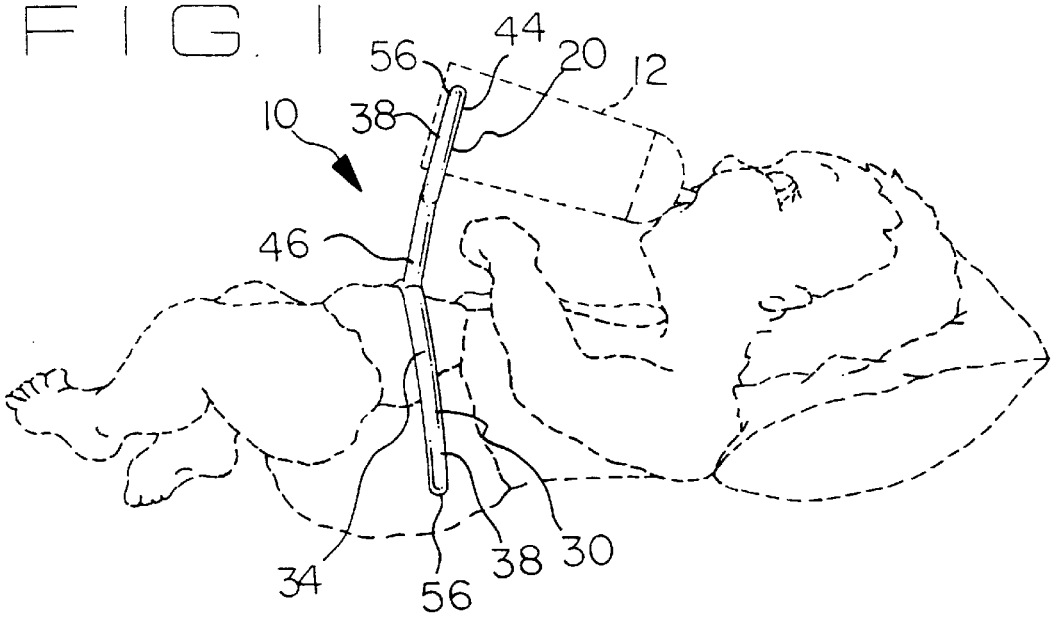
FIG. 1 is a perspective view of the preferred embodiment of the apparatus holding a nursing bottle and fitted onto a child.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
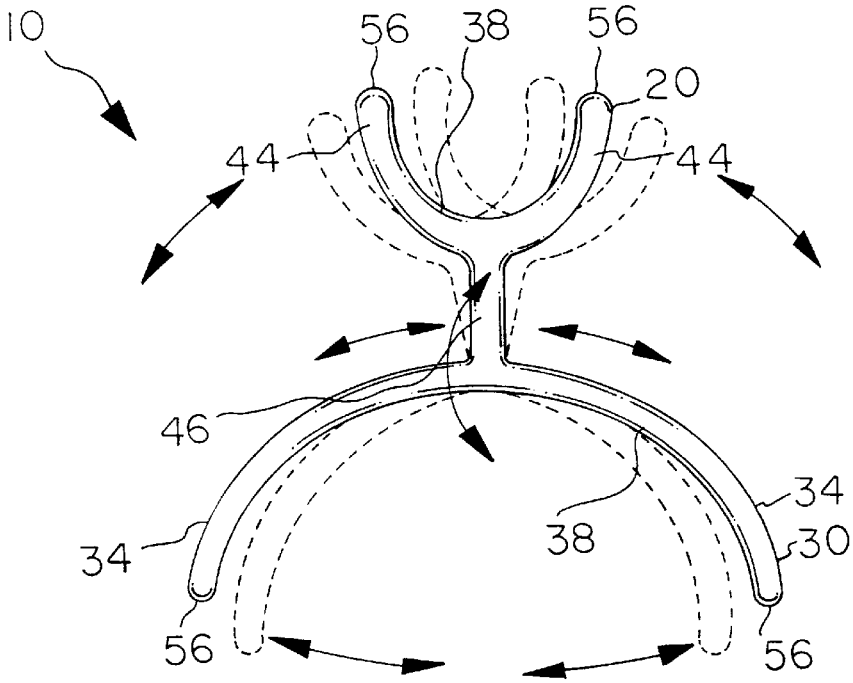
FIG. 2 is a perspective view of the apparatus, showing with arrows and broken lines several configurations into which the flexible members forming the bottle holding portion, the connecting link, and the apparatus mounting portion can be bent to fit children of various sizes and to position the bottle in various locations and orientations.
Figure 3:
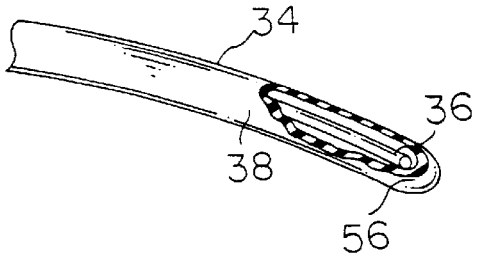
FIG. 3 is a broken-away perspective view of one of the first or second flexible members with some of the high friction material stripped away from the member skeleton segment.
Figure 4:
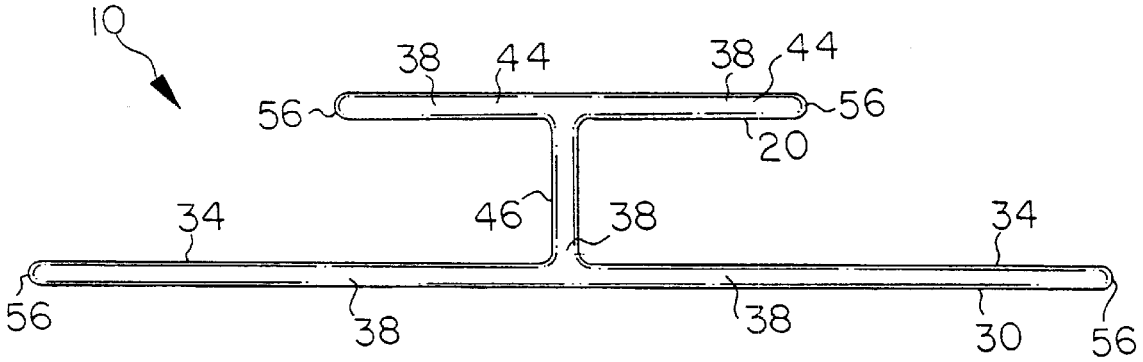
FIG. 4 is a front view of the apparatus as molded, prior tc hand bending for use on a child.
Figure 5:
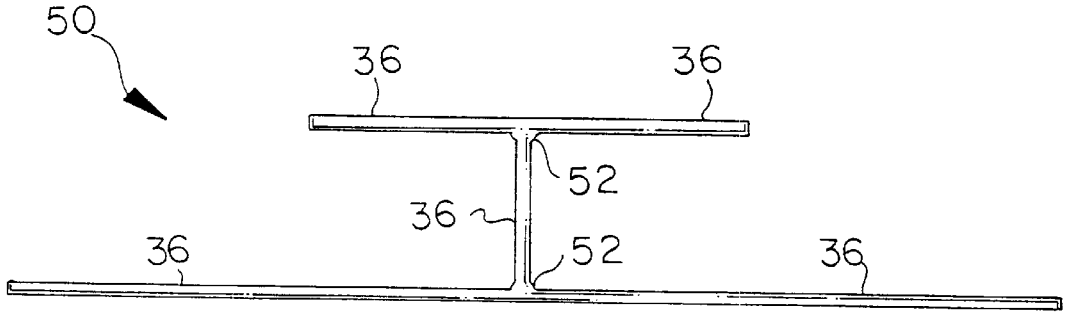
FIG. 5 is a front view of the substantially H-shaped skeleton contained within the apparatus as shown in FIG. 4.

Referring to FIGS. 1–7, a nursing bottle propping apparatus 10 is disclosed for removably securing a nursing bottle 12 to an infant child and for positioning the bottle 12 so that the child can drink from bottle 12. Apparatus 10 includes a bottle holding portion 20 joined to an apparatus mounting portion 30.

Mounting portion 30 includes two mutually diverging first flexible members 34 which wrap against the sides of the waist of an infant child to removably secure apparatus 10 to the child with a light, high-friction grip. See FIGS. 1 and 2. First flexible members 34 each preferably include a skeleton segment 36 of ductile material, such as copper wire of a suitable gauge, which is easily bent to conform to the waist of any particular child. This ductile material has virtually no elastic memory and thus substantially retains the shape into which it was last bent. Alternatively, first flexible members 34 each include a skeleton segment 36 of resilient material having an elastic memory and pre-shaped to lightly grip the front and sides of the infant waist. First flexible members 34 are covered with a high friction material, such as non-toxic rubber tubing 38. See FIG. 3. Preferred tubing materials include FDA closed cell Neoprene sponge and FDA closed cell Nitril rubber.

Bottle holding portion 20 preferably includes two second flexible members 44 affixed to and diverging from a flexible connecting link 46. Connecting link 46 is affixed to and extends from mounting portion 30. Second flexible members 44 and connecting link 46 are preferably of substantially the same construction as first flexible members 34. Second flexible members 44 hold the sides of a nursing bottle 12 with a high friction grip. See FIG. 2. The flexibility of connecting link 46 permits moving and positioning of bottle holding portion 20 and thus of the bottle 12 itself relative to the mouth of the child without moving mounting portion 30. Connecting link 46 permits tilting of the bottle 12 vertically to a desired angle and also permits tilting of the bottle 12 from side to side, depending on the position of the head of the child at the moment. Many other bottle holding structures, including some of the prior art, alternatively may be combined with the inventive apparatus mounting portion 30.

The segments 36 of the ductile or resilient material contained within the first and second flexible members 34 and 44 and within the connecting link 46 are preferably interconnected such as with unified molding or with welds 52 to form a substantially H-shaped apparatus skeleton 50. See FIG. 5. The middle link of the H-shape constitutes connecting link 46. A first upright bar of the H-shape constitutes the two first flexible members 34 diverging from connecting link 46, and a second upright bar of the H-shape constitutes the two second flexible members 44 diverging from connecting link 46. High friction material in the form of the tubing 38 described above is fitted around every segment 36 of skeleton 50, to provide both a high friction holding surface and a soft outer shield against child contact with the skeleton 50 material. See FIGS. 4 and 5. The free ends of the first and second flexible members 34 and 44, respectively, are preferably covered with rounded tip ends 56 of the high friction material.

Second Preferred Embodiment

A second embodiment of apparatus 10 contains no skeleton 50. Instead the first and second flexible members 34 and 44, respectively, and the connecting link 46 are made of a single relatively soft material 58 which has either sufficient elastic memory to resiliently engage the child and nursing bottle 12, or has the ability to retain the shape into which it was last bent. See FIG. 6. The preferred material 58 is a high density polymer rubber. Material 58 also preferably has high-friction characteristics to engage the child and the nursing bottle 12 securely. This construction includes no discontinuities such as welds 52 and no hard inner material to be protectively covered.

For both embodiments of apparatus 10, ring-shaped toys or, equivalently, toys 60 attached to mounting rings 62 are provided and preferably encircle and thereby loosely engage connecting link 46. See FIG. 7. The type and number of toys 60 preferably can be changed. This is accomplished by bending the second flexible members 44, and alternatively the first flexible members 34, outwardly and together, and then sliding one or more mounting rings 62 around these members and on and off apparatus 10. Toys 60 entertain, distract and occupy the child during nursing.

Both embodiments of apparatus 10 are preferably provided in several sizes, including one size for premature babies and another size for ordinary babies. Cover material 38, and alternatively polymer rubber material 58, is preferably offered in a variety of colors and is also preferably formulated to glow in the dark. The glow in the dark feature permits a parent to monitor the position of apparatus 10 in a darkened room, such as while other children are sleeping. See FIG. 7.

It is to be fully understood that a parent should never leave a child unattended while using apparatus 10. Indeed, the glow in the dark feature is offered to make parental supervision and monitoring more effective.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim as our invention:

1. An apparatus for propping a nursing bottle so that an infant child can drink from the bottle, comprising:

an apparatus mounting portion comprising at least two mutually diverging first flexible members, each said first flexible member comprising a skeleton segment of ductile material bendable by hand beyond its elastic limit to reshape and thereby conform to and fit against the waist of an individual child for abutting the sides of the torso of the infant child to removably secure said apparatus to the child with friction engagements;

a bottle holding portion comprising at least two mutually diverging second flexible members, each said second flexible member comprising a skeleton segment of ductile material bendable by hand beyond its elastic limit to reshape and thereby conform to and fit against the sides of said nursing bottle, for abutting the sides of said nursing bottle to removably secure said nursing bottle in said apparatus;

and a flexible connecting link interconnecting said apparatus mounting portion and said bottle holding portion, said connecting link comprising a skeleton segment of ductile material bendable by hand beyond its elastic limit to reshape said connecting link to position said nursing bottle holding portion, and thereby position said nursing bottle, relative to the mouth of the child.

2. The apparatus of claim 1, wherein said first flexible members are at least partly covered with a high friction material.

3. The apparatus of claim 2, wherein said high friction material is non-toxic rubber tubing.

4. The apparatus of claim 2, wherein said high friction material includes means to glow in the dark to permit monitoring by parents in a dark room.

5. The apparatus of claim 1, wherein said skeleton segments of said first and second flexible members and of said connecting link together comprise a substantially H-shaped skeleton of ductile flexible material, said substantially H-shaped skeleton comprising a first upright bar and a second upright bar and a middle link, wherein said middle link of said H-shaped skeleton includes said connecting link, and wherein said first upright bar of said H-shaped skeleton includes said two first flexible members diverging from said connecting link and wherein said second upright bar of said H-shape skeleton includes said two second flexible members diverging from said connecting link.

6. The apparatus of claim 5, wherein high friction material substantially encloses every said segment of said skeleton, to provide high friction apparatus engagement of said bottle and of the child, and to shield the child from direct contact with said skeleton.

7. The apparatus of claim 1, wherein said first flexible members are formed of a polymer rubber material capable of being bent by hand to conform to and fit against the waist of an individual child and to substantially retain the shape into which the material was last bent.

8. The apparatus of claim 7, wherein said polymer rubber material includes means to glow in the dark to permit monitoring by parents in a dark room.

9. The apparatus of claim 1, wherein said first flexible members are formed of a resilient polymer rubber material having an elastic memory and pre-shaped to lightly and resiliently grip the front and sides of the infant waist.

10. The apparatus of claim 9, wherein said polymer rubber material includes means to glow in the dark to permit monitoring by parents in a dark room.

11. The apparatus of claim 1, additionally comprising:

a flexible connecting link interconnecting said bottle holding portion and said apparatus mounting portion, for positioning said nursing bottle holding portion, and thereby positioning said bottle, relative to the mouth of the child;

and a child entertaining object having a ring portion, said ring portion slidably encircling said connecting member.

12. A nursing bottle propping apparatus for an infant child, comprising:

a nursing bottle;

an apparatus mounting portion comprising at least two mutually diverging first flexible members, each said first flexible member comprising a skeleton segment of ductile material bendable by hand beyond its elastic limit to reshape and thereby conform to and fit against the waist of an individual child for abutting the sides of the torso of an infant child to removably secure said apparatus to the child with friction engagement;

a bottle holding portion comprising at least two mutually diverging second flexible members, each said second flexible member comprising a skeleton segment of ductile material bendable by hand beyond its elastic limit to reshape and thereby conform to and fit against the sides of a nursing bottle, for abutting the sides of said nursing bottle to removably secure said nursing bottle in said apparatus;

and a flexible connecting link interconnecting said apparatus mounting portion and said bottle holding portion, said connecting link comprising a skeleton segment of ductile material bendable by hand to position said nursing bottle holding portion, and thereby position said nursing bottle, relative to the mouth of the child.

13. The apparatus of claim 12, wherein said apparatus mounting portion is formed of a polymer rubber material capable of being bent by hand to conform to and fit against the waist of an individual child and to substantially retain the shape into which the material was last bent.

14. The apparatus of claim 12, wherein said apparatus mounting portion is formed of a resilient polymer rubber material having an elastic memory and pre-shaped to lightly and resiliently grip the front and sides of the infant waist.

15. The apparatus of claim 12, wherein said apparatus mounting portion comprises a ductile interior skeleton.

16. The apparatus of claim 12, wherein said apparatus comprises material including means for glowing in the dark for parent monitoring in a dark room.

17. An apparatus for propping a nursing bottle so that an infant child can drink from the bottle, comprising:

an apparatus mounting portion for engaging the torso of an infant child to removably secure said apparatus to the child;

a bottle holding portion for removably securing said nursing bottle in said apparatus;

and a flexible connecting link interconnecting said apparatus mounting portion and said bottle holding portion, said connecting link comprising a skeleton segment of ductile material bendable by hand beyond its elastic limit to reshape said flexible connecting link to position said nursing bottle holding portion, and thereby position said nursing bottle, relative to the mouth of the child.

18. An apparatus for propping a nursing bottle so that an infant child can drink from the bottle, comprising:

an apparatus mounting portion comprising at least two mutually diverging first flexible members, each said first flexible member comprising a skeleton segment of ductile material bendable by hand beyond its elastic limit to reshape and thereby conform to and fit against the waist of an individual child for abutting the sides of the torso of an infant child to removably secure said apparatus to the child with friction engagement;

a bottle holding portion;

and connecting means interconnecting said apparatus mounting portion and said bottle holding portion.

* * * * *